US011572856B2

(12) United States Patent
Park et al.

(10) Patent No.: US 11,572,856 B2
(45) Date of Patent: Feb. 7, 2023

(54) DAMPER SPRING STRUCTURE FOR REDUCING RADIATION NOISE OF HIGH-PRESSURE FUEL-PUMP

(71) Applicant: HYUNDAI KEFICO CORPORATION, Gyeonggi-do (KR)

(72) Inventors: Hyeong Kyun Park, Gyeonggi-do (KR); Kyung Chul Han, Gyeonggi-do (KR); Jin Sung Kim, Seoul (KR)

(73) Assignee: Hyundai Kefico Corporation, Gyeonggi-Do (KR)

( * ) Notice: Subject to any disclaimer, the term of this patent is extended or adjusted under 35 U.S.C. 154(b) by 0 days.

(21) Appl. No.: 17/523,494

(22) Filed: Nov. 10, 2021

(65) Prior Publication Data

US 2022/0145838 A1 May 12, 2022

(30) Foreign Application Priority Data

Nov. 10, 2020 (KR) ..... 10-2020-0149085

(51) Int. Cl.
*F02M 55/04* (2006.01)
*F02M 59/02* (2006.01)

(52) U.S. Cl.
CPC ..... *F02M 55/04* (2013.01); *F02M 59/02* (2013.01); *F02M 59/025* (2013.01); *F02M 2200/09* (2013.01); *F02M 2200/315* (2013.01)

(58) Field of Classification Search
CPC ..... F02M 55/04; F02M 59/02; F02M 59/025; F02M 2200/09; F02M 2200/315
USPC ..... 123/468, 469, 507, 508
See application file for complete search history.

(56) References Cited

U.S. PATENT DOCUMENTS

| | | | | |
|---|---|---|---|---|
| 2015/0132165 | A1* | 5/2015 | Inoue | F02M 59/44 417/435 |
| 2016/0131097 | A1* | 5/2016 | Matsuo | F02M 55/04 123/495 |
| 2019/0024646 | A1* | 1/2019 | Kurt | F16L 55/053 |
| 2019/0048837 | A1* | 2/2019 | Mikhaylov | F02M 55/04 |
| 2019/0301413 | A1* | 10/2019 | Ogane | F02M 55/04 |
| 2020/0080526 | A1* | 3/2020 | Kawano | F02M 59/366 |
| 2020/0309076 | A1* | 10/2020 | Kazour | F02M 59/445 |
| 2021/0079853 | A1* | 3/2021 | Jeon | F02D 1/00 |
| 2021/0262425 | A1* | 8/2021 | Yanagiya | F02M 55/04 |
| 2021/0372353 | A1* | 12/2021 | Akiyama | F02M 55/04 |
| 2022/0082072 | A1* | 3/2022 | Usui | F04B 53/10 |

* cited by examiner

*Primary Examiner* — Erick R Solis
(74) *Attorney, Agent, or Firm* — Fox Rothschild LLP; Peter F. Corless

(57) ABSTRACT

A damper spring structure of a high-pressure fuel pump includes: a housing of the high-pressure fuel pump in which a flow path for fuel is formed; a lid coupled to the housing and having an accommodation space between the housing and the lid; a damper spring installed in the accommodation space between the housing and the lid; and a damper installed in the damper spring so as to be supported by the damper spring, in which the damper spring is seated and supported on the lid and the housing in the accommodation space by contact points, and the lid is supported at a plurality of contact points.

11 Claims, 9 Drawing Sheets

DAMPER SPRING STRUCTURE FOR REDUCING RADIATION NOISE OF HIGH-PRESSURE FUEL-PUMP

CROSS-REFERENCE TO RELATED APPLICATION(S)

This application claims under 35 U.S.C. § 119 the benefit of Korean Patent Application No. 10-2020-0149085 filed on Nov. 10, 2020, the entire contents of which are incorporated herein by reference.

BACKGROUND

(a) Technical Field

The present disclosure relates to a damper spring structure of a high-pressure fuel pump, more particularly, to the damper spring structure for reducing radiation noise of the high-pressure fuel pump, which is capable of reducing vibration and noise radiating to the outside through a lid by reinforcing rigidity of the lid by a damper spring provided in the form of a flat spring for supporting a damper, and integrating a structure for fixing the damper with the damper spring in an accommodation space between the lid and a housing.

(b) Description of the Related Art

In general, a direct injection engine has been developed to increase an output of the engine and improve fuel economy and performance by enabling ultra-lean combustion by injecting fuel directly into a combustion chamber.

One key component of the direct injection engine is a high-pressure fuel pump capable of compressing, at a high pressure, fuel to be supplied into the combustion chamber.

In the related art, the high-pressure fuel pump of the direct injection engine is necessarily accompanied by pulsation during a process of compressing fuel at a high pressure. To solve a problem with the pulsation, a damper for reducing the pulsation is installed at one side of the pump.

In the related art, the damper installed in the high-pressure fuel pump is installed in an accommodation space between a lid and a housing and supported in a vertical direction by a damper spring provided in the form of a flat spring. In addition, the damper needs to have a large surface area to quickly cope with a wide range of pressure precision.

To this end, the damper spring for supporting the damper is manufactured by pressing a thin board in order to ensure economic feasibility and assembly space.

However, vibration and noise occur in the high-pressure fuel pump in the related art due to an internal flow of fuel caused by operations of various types of valves and pistons. The vibration and noise are transmitted to the lid having a large cross-sectional area through the housing, and the thin lid serves as a kind of vibration plate, which increases the occurring vibration and noise and radiates the vibration and noise to the outside.

In addition, the high-pressure fuel pump in the related art has a dome-shaped structure for reinforcing the rigidity of the material and reducing the vibration and noise occurring from the lid. However, a central portion, which is relatively distant from a coupling portion of the housing, is still vulnerable to the occurrence of vibration and noise.

Therefore, the lid in the related art is manufactured using a thicker material in order to reinforce rigidity of the lid. However, in this case, formability deteriorates, and turning machining is additionally performed on a welded portion, which is disadvantageous in terms of economic feasibility.

In addition, it is difficult to reduce a size of the damper of the high-pressure fuel pump in the related art because a surface area needs to be ensured. If the pulsation of fuel is high, the operation of the valve controlling a flow rate becomes unstable, and a sealing component such as a rubber ring for sealing the pump is damaged.

In addition, because the damper spring for supporting the damper is hardly supported in a horizontal direction in the high-pressure fuel pump in the related art, there is a likelihood that the damper separates from a normal position during the processes of assembling and operating the damper. Further, there is a problem in that additional components need to be fitted to fix the damper.

SUMMARY

An object of the present disclosure is to provide a damper spring structure of a high-pressure fuel pump, in which an additional shape is provided inside a damper support portion of a damper spring for supporting both a damper and a central portion of a lid, the damper spring structure being capable of reducing radiation noise.

Another object of the present disclosure is to provide a damper spring structure for reducing radiation noise of a high-pressure fuel pump, which is capable of preventing a position separation by automatically guiding a damper spring to a center position of each object by providing an inclined surface between support portions during the assembly and operational process.

To achieve the above-mentioned objects, the present disclosure provides a damper spring structure of a high-pressure fuel pump, the damper spring structure including: a housing of the high-pressure fuel pump in which a flow path for fuel is formed; a lid coupled to the housing and having an accommodation space between the housing and the lid; a damper spring installed in the accommodation space between the housing and the lid; and a damper installed in the damper spring so as to be supported by the damper spring, in which the damper spring is seated and supported on the lid and the housing in the accommodation space by contact points.

In the embodiment of the present disclosure, the contact points may include: a contact surface portion and an inclined surface portion provided on an outer peripheral surface of the damper spring, and corresponding surface portions respectively provided on inner peripheral surfaces of the housing and the lid so as to be in contact with the contact surface portion and the inclined surface portion.

In the embodiment of the present disclosure, the contact surface portion and the inclined surface portion may be disposed to be spaced apart from a central portion of the damper spring in a concentric circular shape, and the corresponding surface portions may be disposed to be spaced apart from central portions of the housing and the lid in a concentric circular shape.

In the embodiment of the present disclosure, the contact surface portion may include: a first support surface configured to seat and support the damper, a second support surface positioned radially inward from the first support surface and configured to be in contact with and supported by any one of the housing and the lid, and a third support surface positioned radially inward from the second support surface, disposed on a central portion, and configured to be in contact with and supported by the lid.

In the embodiment of the present disclosure, the contact surface portion may be configured such that the second support surface and the third support surface have different protrusion heights with respect to the first support surface.

In the embodiment of the present disclosure, the contact surface portion may be configured such that the second support surface and the third support surface have different elastic forces.

In the embodiment of the present disclosure, the inclined surface portion may include: a first inclined surface configured to inclinedly connect the first support surface and the second support surface, and a second inclined surface configured to inclinedly connect the second support surface and the third support surface.

In the embodiment of the present disclosure, the corresponding surface portion provided on the lid may include: the first support surface configured to be in contact with the second support surface of the damper spring, and the second support surface positioned radially inward from the first support surface, and disposed on the central portion, and configured to be in contact with the third support surface of the damper spring.

In the embodiment of the present disclosure, the second support surface of the lid may have a higher protrusion height than the first support surface of the lid to accommodate a second inclined surface and the third support surface of the damper spring and allow an edge portion thereof to come into contact with the second inclined surface and the third support surface of the damper spring.

In the embodiment of the present disclosure, the corresponding surface portion provided on the housing may include: a seating surface configured to be in contact with the second support surface of the damper spring, and a base surface positioned radially inward from the seating surface and configured to accommodate the second inclined surface of the damper spring and the third support surface of the damper spring.

In the embodiment of the present disclosure, the housing may have a center hole formed in a central portion of the seating surface to accommodate the second inclined surface and the third support surface of the damper spring.

In the embodiment of the present disclosure, the damper spring may define a vertical symmetric structure separated vertically and including an upper damper spring disposed to face the lid and a lower damper spring disposed to face the housing.

According to the damper spring structure of the high-pressure fuel pump according to the embodiment of the present disclosure, the rigidity of the lid may be enhanced by the damper spring provided in the form of a flat spring for supporting the damper, and the central portion of the lid may be stably supported by the damper spring. Therefore, it is possible to increase structural rigidity of the lid and reduce noise radiating to the outside due to vibration while the high-pressure fuel pump operates, thereby actively meeting severe customer requirements associated with NVH and sensitive quality.

In addition, according to the damper spring structure of the high-pressure fuel pump according to the embodiment of the present disclosure, the damper springs, in which the damper is accommodated, are divided into the upper and lower damper springs having the same structure. Therefore, the structurally integrated support structure of the component for fixing the damper may simplify the assembly process and reduce the manufacturing costs of the component.

In addition, according to the damper spring structure of the high-pressure fuel pump according to the embodiment of the present disclosure, the damper springs are assembled in the accommodation space between the lid and the housing by the support structure having the inclined surfaces set at the plurality of contact points with the damper springs. Therefore, it is possible to seat the components at the exact positions by easily adjusting the concentricity between the components. Further, the components may be smoothly returned to the exact positions in the assembled state even though the force is generated due to vibration, impact, and pulsation during the operation.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments according to the present disclosure will be described in detail with reference to the accompanying drawings.

Figure 1:
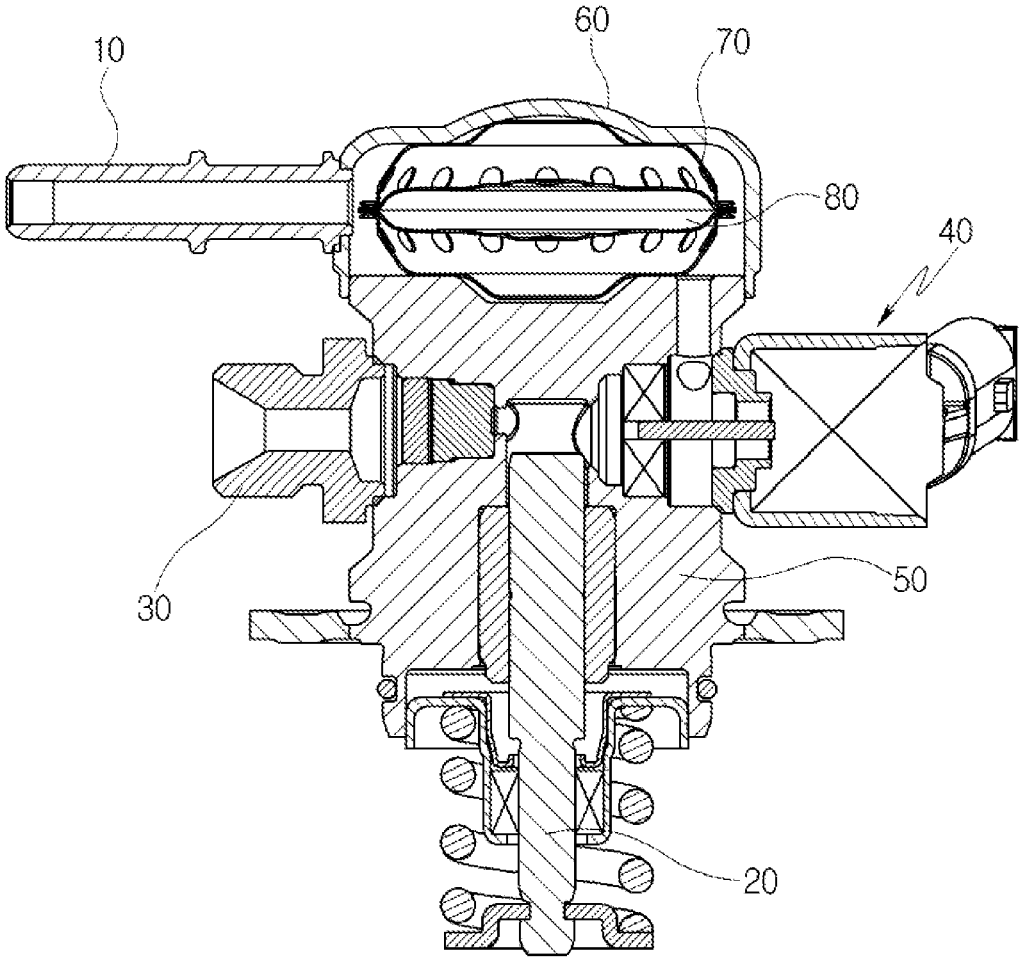
FIG. 1 is a cross-sectional view for explaining an internal structure of a high-pressure fuel pump to which an embodiment of the present disclosure is applied.

Referring to FIG. 1, a high-pressure fuel pump to which an embodiment of the present disclosure is applied includes: a supply tube 10 configured to supply low-pressure fuel; a piston 20 configured to compress the low-pressure fuel, supplied through the supply tube 10, into high-pressure fuel; a discharge tube 30 configured to supply a combustion chamber of an internal combustion engine with the fuel compressed at high pressure by the operation of the piston 20; a flow rate control valve 40 configured to adjust the amount of fuel, which is to be supplied to the combustion chamber of the internal combustion engine through the discharge tube 30, to an appropriate amount depending on an operating condition; and a cylindrical housing 50 configured to communicate with the supply tube 10 and the discharge tube 30 and allow the piston 20 and the flow rate control valve 40 to be installed therein.

In this case, the piston 20 compresses the low-pressure fuel, which is introduced into the pressure chamber, into the high-pressure fuel while being reciprocatingly moved in an upward/downward direction by an external force. In addition, the flow rate control valve 40 adjusts the amount of high-pressure fuel by turning on or off an electronic solenoid or performing control such as duty control on the electronic solenoid and supplies the fuel into the combustion chamber through the discharge tube 30.

Further, in the high-pressure fuel pump to which the embodiment of the present disclosure is applied, strike and flow noise occur during the process of compressing the fuel by the upward downward movements of the piston 20, the process of controlling the discharge amount of fuel by the operation of the flow rate control valve 40, and the process of discharging the fuel through the discharge tube 30. In consideration of this situation, the high-pressure fuel pump includes a hollow lid 60 assembled to an upper portion of the cylindrical housing 50, damper springs 70 installed in an accommodation space defined between the housing 50 and the lid 60, and a damper 80 installed between the damper springs 70 and having an interior filled with and encapsulating high-pressure compressed gas.

That is, in the high-pressure fuel pump, the lid 60 and the damper springs 70 are provided to accommodate and support the damper 80 and prevent a welded portion of the damper 80 from being damaged by a pressure caused by pulsation of fuel. In addition, the damper 80 is configured to reduce the pulsation of the fuel in the pump, thereby increasing precision in controlling the flow rate and protecting components.

Figure 2:
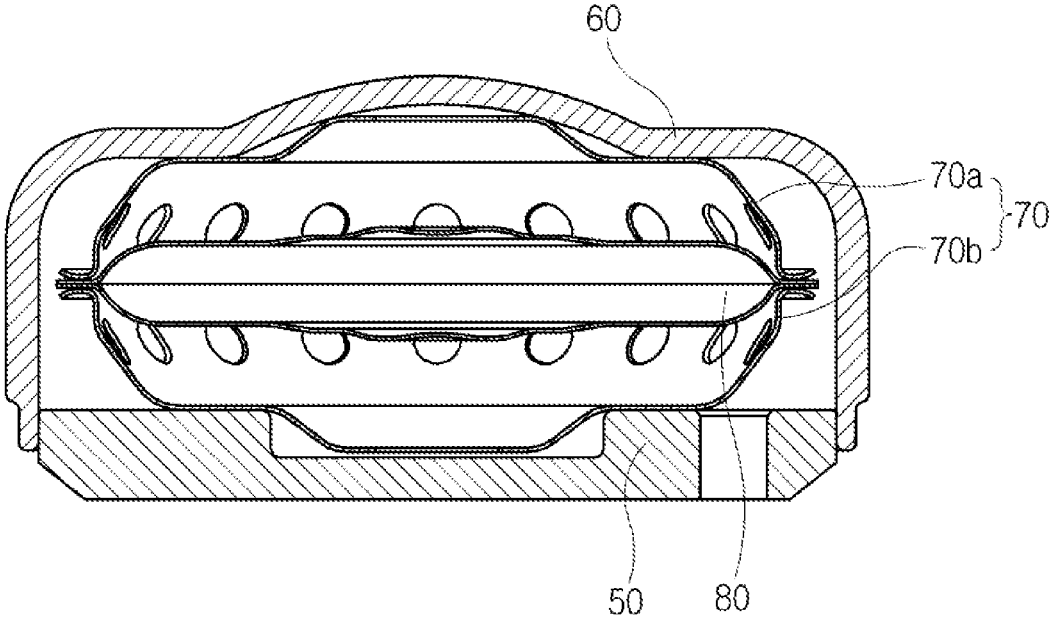
FIG. 2 is a cross-sectional view illustrating a state in which a damper and a damper spring, which are installed in an accommodation space between a housing and a lid of a high-pressure fuel pump, are assembled, for explaining the damper spring structure of the high-pressure fuel pump according to the embodiment of the present disclosure.
Figure 3:
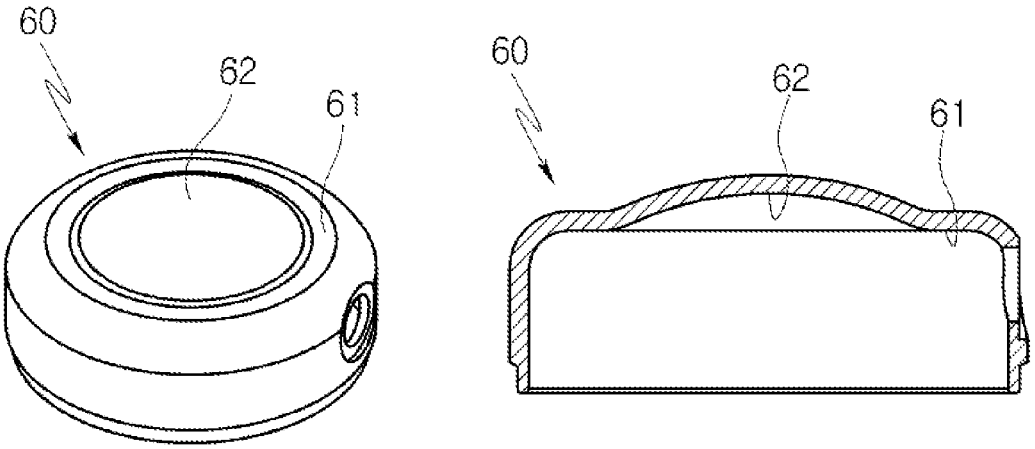
FIG. 3 illustrates a perspective view and a cross-sectional view of the lid illustrated in FIG. 2.

Referring to FIGS. 2 and 3, the lid 60 has a hollow structure assembled to the upper portion of the cylindrical housing 50 and may communicate with the supply tube 10. In addition, the lid 60 is configured such that the accommodation space having a predetermined volume is defined between the lid 60 and the housing 50, and the damper springs 70 and the damper 80 are installed in the accommodation space.

Figure 4:
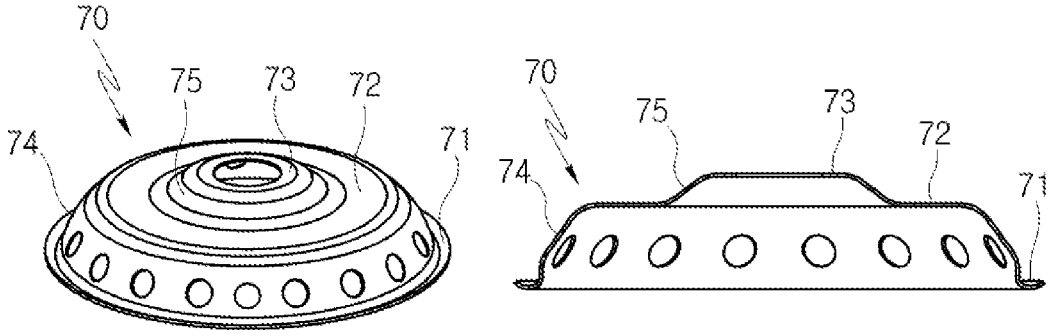
FIG. 4 illustrates a perspective view and a cross-sectional view illustrating an upper damper spring separated from the damper spring illustrated in FIG. 2 and including the upper damper spring and a lower damper spring.

Referring to FIGS. 2 and 4, the damper springs 70 are seated and supported in the accommodation space between the housing 50 and the lid 60. In the embodiment of the present disclosure, the damper springs 70 include an upper damper spring 70*a* and a lower damper spring 70*b* which are separated vertically. The upper damper spring 70*a* is disposed to face the lid 60, and the lower damper spring 70*b* is disposed to face the housing 50. In particular, the upper damper spring 70*a* and the lower damper spring 70*b*, which constitute the damper springs 70, may be structured to be horizontally symmetric and have the same shape.

In addition, the upper damper spring 70*a* and the lower damper spring 70*b*, which constitute the damper springs 70, are in contact with and seated on the housing 50 and the lid 60 and disposed in the accommodation space, respectively. In this case, the damper spring 70 may be in contact with the housing 50 at a single contact point, and the damper spring 70 may be in contact with the lid 60 at a single contact point. However, a plurality of contact points may be provided.

Figure 5:
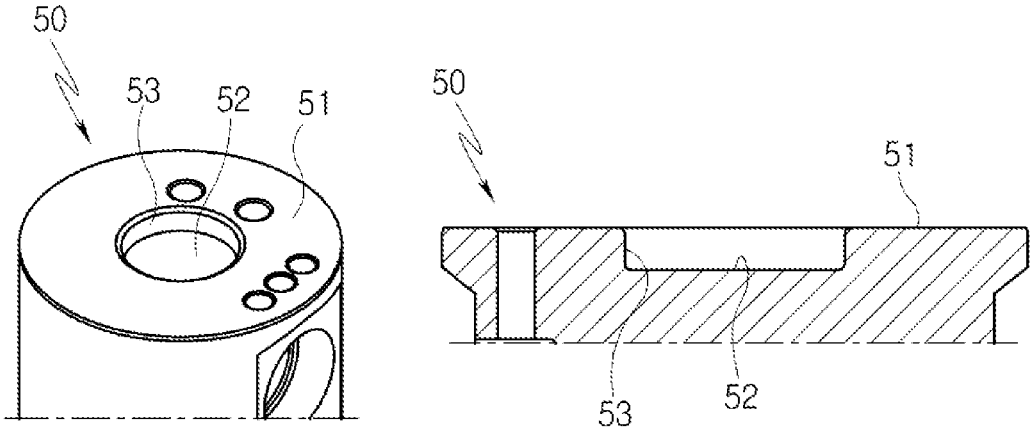
FIG. 5 illustrates a perspective view and a cross-sectional view of the housing illustrated in FIG. 2.

For example, as illustrated in FIGS. 3 to 5, the contact points of the damper springs 70 being in contact with the housing 50 and the lid 60 include contact surface portions and inclined surface portions provided on outer peripheral surfaces of the damper springs 70, and corresponding surface portions are respectively provided on inner peripheral surfaces of the housing 50 and the lid 60 so as to be in contact with the contact surface portions and the inclined surface portions.

In addition, the contact surface portions and the inclined surface portions, which are provided on the outer peripheral surfaces of the damper springs 70, may be disposed to be spaced apart from central portions of the damper springs 70 in a concentric circular shape. Therefore, the damper spring 70 may have a shape similar to a multi-stage dish-shaped flat spring member having one or more contact surface portions and one or more inclined surface portions formed on the outer peripheral surface thereof.

In addition, the corresponding surface portions respectively provided on the inner peripheral surfaces of the housing 50 and the lid 60 may be disposed to be spaced apart from the central portions of the housing 50 and the lid 60 in the concentric circular shape. That is, the corresponding surface portions provided on the inner peripheral surfaces of the housing 50 and the lid 60 are individually in contact with and securely support the contact surface portions and the inclined surface portions provided on the outer peripheral surfaces of the damper springs 70, such that the elastic motion in an opposite phase generated by the damper springs 70 effectively attenuates the pulsation of the damper 80 that occurs when the high-pressure fuel pump operates.

First, as illustrated in FIG. 4, the contact surface portion provided on the outer peripheral surface of the damper spring 70 includes: a first support surface 71 positioned on a periphery of an edge of the damper spring 70 and configured to seat and support a flange portion positioned on a periphery of an edge of the damper 80; a second support surface 72 positioned radially inward from the first support surface 71 and supported by being in contact with any one of the housing 50 and the lid 60; and a third support surface 73 positioned radially inward from the second support surface 72, disposed on the central portion, and supported by being in contact with the lid 60.

In this case, in the contact surface portion provided on the outer peripheral surface of the damper spring 70, the second support surface 72 and the third support surface 73 have different protrusion heights with respect to the first support surface 71. Particularly, the second support surface 72 and the third support surface 73 each have a higher protrusion height than the first support surface 71, and the third support surface 73 has a higher protrusion height than the second support surface 72.

In addition, in the contact surface portion provided on the outer peripheral surface of the damper spring 70, an inner diameter portion of the first support surface 71 may have a round shape, such that concentricity between the damper spring 70 and the damper 80 may be automatically adjusted when the damper spring 70 is assembled with the damper 80.

In addition, in the contact surface portion provided on the outer peripheral surface of the damper spring 70, the second support surface 72 and the third support surface 73 may have different elastic forces. Therefore, a support surface of any one of the second support surface 72 and the third support surface 73 may be elastically deformed first by being brought into contact with the counterpart component, and then the other of the second support surface 72 and the third support surface 73 may be resiliently supported by the counterpart component during the assembly process, such that the inclined surface portion to be described below and formed between the plurality of support surfaces is guided to a hole of the counterpart component so that the concentricities between the components are accurately coincident.

Further, the inclined surface portion provided on the outer peripheral surface of the damper spring 70 includes: a first inclined surface 74 configured to inclinedly connect the first support surface 71 and the second support surface 72; and a second inclined surface 75 configured to inclinedly connect the second support surface 72 and the third support surface 73. In particular, based on the first support surface 71, the second inclined surface 75 has a higher protrusion height than the first inclined surface 74.

Therefore, the second support surface 72 of the upper damper spring 70*a* may be guided to the central portion of the lid 60 and easily seated on a second support surface 62 to be described below by setting the second inclined surface 75. In addition, the second support surface 72 of the lower damper spring 70*b* may be accommodated in a center hole 53 of the housing 50 to be described below and restrict a radial motion by setting the second inclined surface 75.

In addition, as illustrated in FIG. 3, the corresponding surface portion of the lid 60 includes: a first support surface 61 positioned at a periphery of an edge of the lid 60 so as to be in contact with the second support surface 72; and the second support surface 62 positioned radially inward from the first support surface 61, disposed on the central portion, and configured to be in contact with the third support surface 73.

In this case, the second support surface 62 of the lid 60 has a different protrusion height from the first support surface 61 to accommodate the second inclined surface 75 and the third support surface 73 of the damper spring 70 and allow edge portions thereof to come into contact with the second inclined surface 75 and the third support surface 73 of the damper spring 70. For example, according to the embodiment of the present disclosure, the second support surface 62 of the lid 60 has a shape convex upward and has a higher protrusion height than the first support surface 61. Therefore, the second support surface 62 of the lid 60 guides the second inclined surface 75 of the upper damper spring 70*a*, such that the concentricity between the damper spring 70 and the lid 60 may be automatically adjusted when the lid 60 is assembled with the damper spring 70.

In addition, as illustrated in FIG. 5, the corresponding surface portion of the housing 50 includes: a seating surface 51 positioned at a periphery of an edge so as to be in contact with the second support surface 72; and a base surface 52 positioned radially inward from the seating surface 51 and configured to accommodate the second inclined surface 75 and the third support surface 73 therein.

In this case, the base surface 52 of the housing 50 may be positioned on a base portion of the center hole 53 positioned at the central portion of the seating surface 51 to accommodate the second inclined surface 75 and the third support surface 73 of the lower damper spring 70*b*.

As illustrated in FIG. 2, the damper 80 is installed in the internal space between the upper damper spring 70*a* and the lower damper spring 70*b* that constitute the damper spring 70. The damper 80 is provided in the form of a diaphragm having the interior filled with and encapsulating high-pressure compressed gas to reduce the pulsation of the fuel that occurs during the operation of the high-pressure fuel pump.

Figure 6:
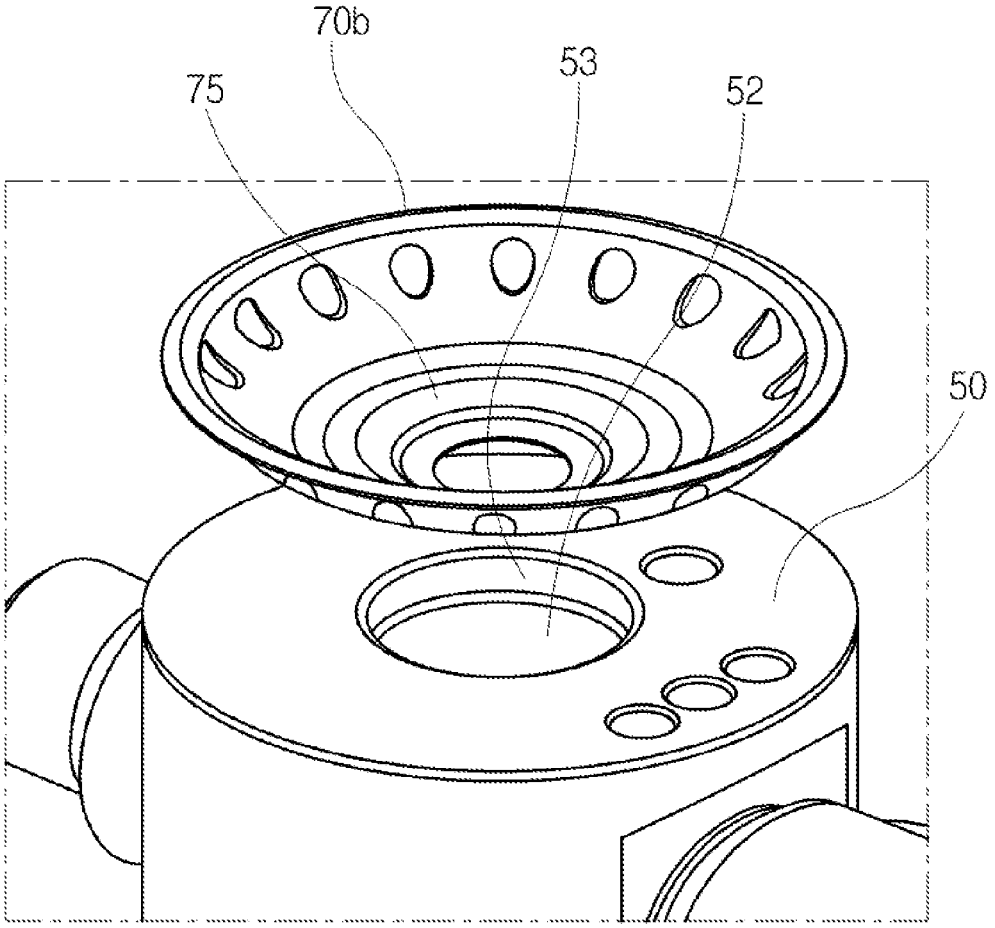
FIGS. 6 to 8 are perspective views sequentially illustrating processes of assembling the damper and the damper spring in the accommodation space between the lid and the housing of the high-pressure fuel pump to which the embodiment of the present disclosure is applied.
Figure 7:
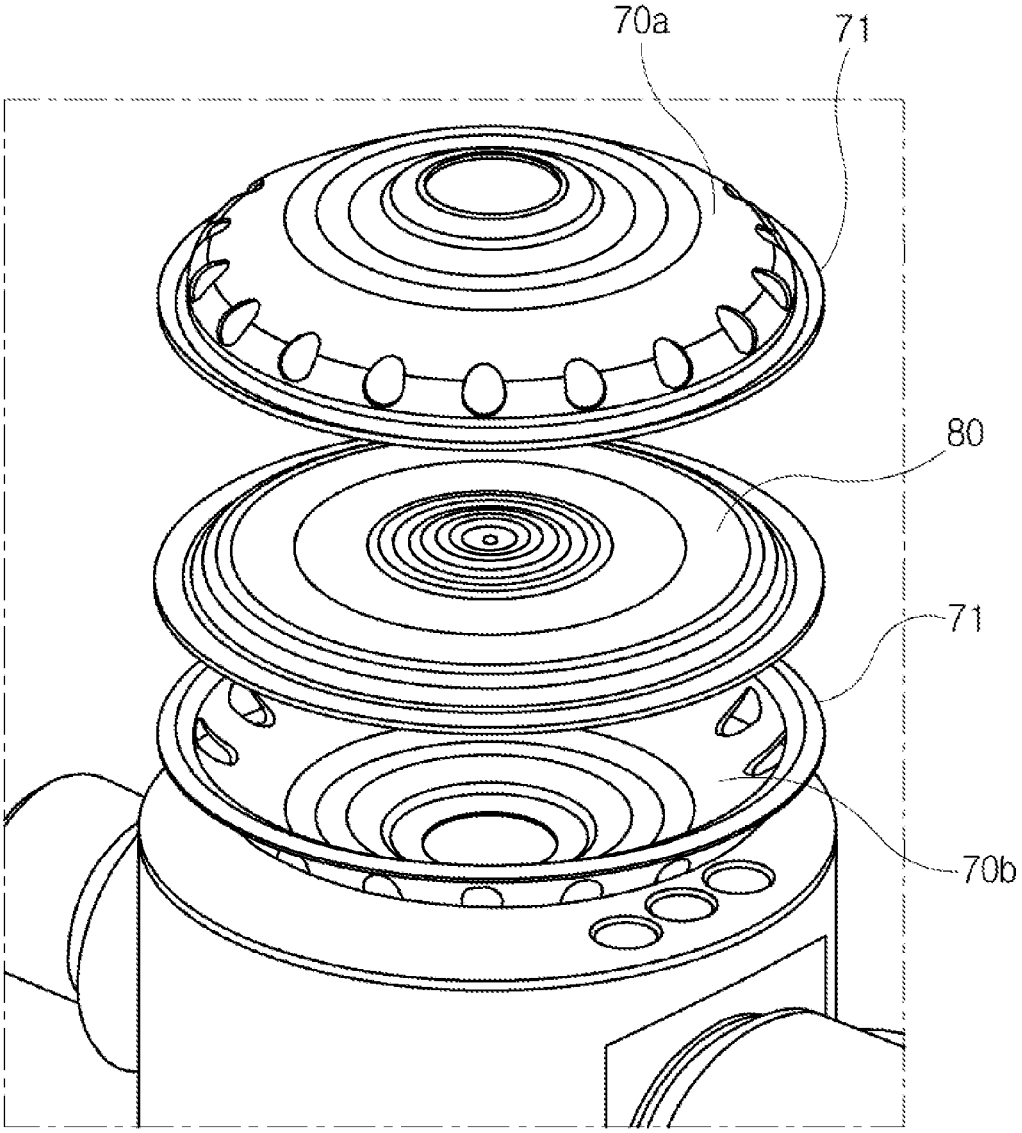
Figure 8:
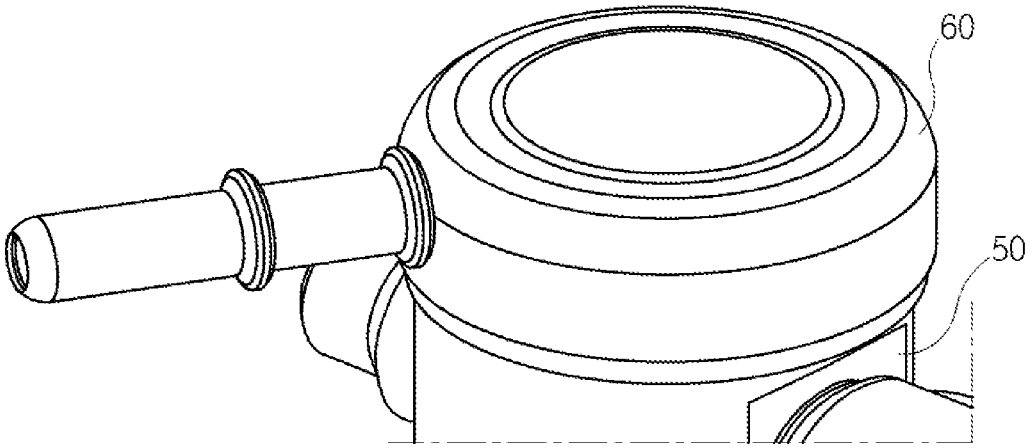
Figure 9:
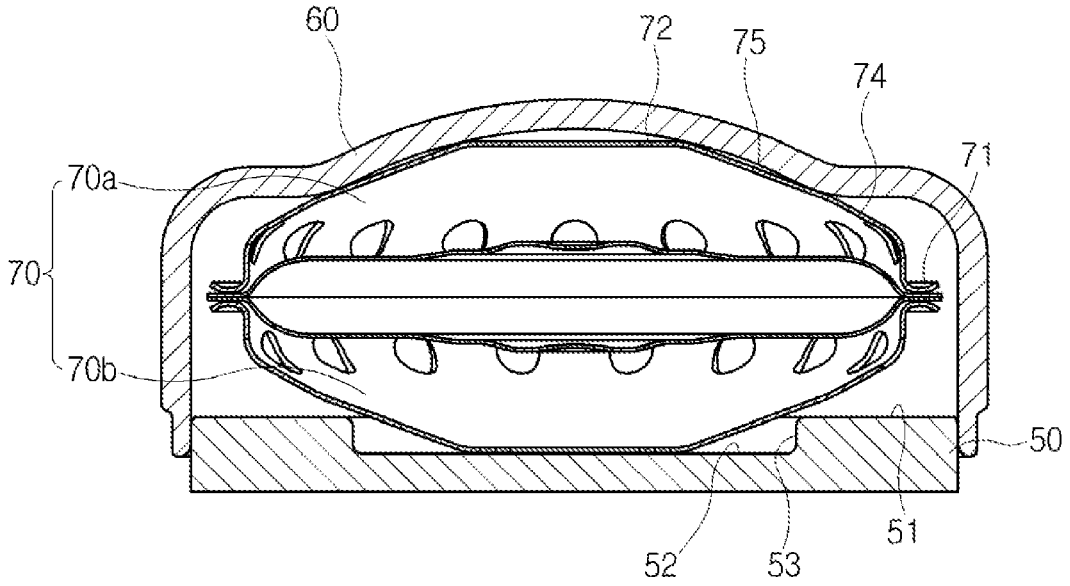
FIG. 9 is a cross-sectional view for explaining another embodiment of the damper spring installed in the accommodation space between the lid and the housing of the damper spring structure of the high-pressure fuel pump according to the embodiment of the present disclosure.

Referring to FIGS. 6 to 8, in the high-pressure fuel pump according to the embodiment of the present disclosure, the damper springs 70 and the damper 80 are assembled in the accommodation space between the housing 50 and the lid 60, as follows.

First, the lower damper spring 70*b* is assembled by being seated in the center hole 53 of the housing 50. In this process, the second inclined surface 75 of the lower damper spring 70*b* is guided toward the base surface 52 by being brought into contact with the edge portion of the center hole 53, such that the concentricity may be accurately adjusted.

Then, the damper 80 is seated on an upper portion of the lower damper spring 70*b*, and then the upper damper spring 70*a* is seated on an upper portion of the damper 80. In this process, the flange portion positioned on the edge portion of the damper 80 is positioned so that the damper 80 may be securely supported between the first support surfaces 71 of the upper damper spring 70*a* and the lower damper spring 70*b*. As a result, it is possible to prevent the welded portion for the flange portion of the damper 80 from being damaged even though the inside of the damper 80 is further compressed by a pulsation load applied from the outside.

Then, the lid 60 is assembled to cover an upper space of the damper spring 70, and the edge portion of the lid 60 is fitted with the edge portion of the housing 50 and then securely fixed by welding. In this process, the second inclined surface 75 of the upper damper spring 70*a* may be guided toward a central portion of the second support surface 62 by being brought into contact with the second support surface 62 of the lid 60, such that the concentricity may be accurately adjusted.

Meanwhile, as illustrated in FIG. 7, according to another embodiment of the present disclosure, the damper springs 70 includes the upper damper spring 70*a* and the lower damper spring 70*b* which are separated vertically and symmetrically and assembled in the accommodation space between the housing 50 and the lid 60. The upper damper spring 70*a* and the lower damper spring 70*b* may each have the structure including: the first support surface 71 positioned on the edge portion thereof; the first inclined surface 74 positioned radially inward from the first support surface 71; and the second support surface 72 positioned inward from the first inclined surface 74 and disposed on the central portion.

In addition, the first inclined surface 74 may have a second inclined surface 75 continuously formed between the first support surface 71 and the second support surface 72 and having different inclination angles to implement different degrees of elastic forces.

In this case, any one of the first inclined surface 74 and the second inclined surface 75 of the lower damper spring 70*b* may be in contact with and seated on the edge portion between the seating surface 51 and the center hole 53 of the housing 50.

Alternatively, the lower damper spring 70*b* may be seated in the state in which the second inclined surface 75 is in contact with the base surface 52 of the center hole 53 of the housing 50 first.

That is, according to another embodiment of the present disclosure, a degree of pre-compression on the damper spring 70 may be differently set by changing the contact portions between the housing 50 and the lower damper spring 70*b* at the time of assembling the damper spring 70 in the accommodation space between the housing 50 and the lid 60.

What is claimed is:

1. A damper spring structure of a high-pressure fuel pump, the damper spring structure comprising:

a housing of the high-pressure fuel pump in which a flow path for fuel is formed;

a lid coupled to the housing and having an accommodation space between the housing and the lid;

a damper spring installed in the accommodation space between the housing and the lid; and a damper installed in the damper spring so as to be supported by the damper spring, wherein the damper spring is seated and supported on the lid and the housing in the accommodation space by contact points, wherein the contact points comprise:

a contact surface portion and an inclined surface portion provided on an outer peripheral surface of the damper spring, and corresponding surface portions respectively provided on inner peripheral surfaces of the housing and the lid so as to be in contact with the contact surface portion and the inclined surface portion.

2. The damper spring structure of claim 1, wherein the contact surface portion and the inclined surface portion are disposed to be spaced apart from a central portion of the damper spring in a concentric circular shape, and the corresponding surface portions are disposed to be spaced apart from central portions of the housing and the lid in a concentric circular shape.

3. The damper spring structure of claim 2, wherein the contact surface portion comprises:

a first support surface configured to seat and support the damper, a second support surface positioned radially inward from the first support surface and configured to be in contact with and supported by any one of the housing and the lid, and a third support surface positioned radially inward from the second support surface, disposed on a central portion, and configured to be in contact with and supported by the lid.

4. The damper spring structure of claim 3, wherein the contact surface portion is configured such that the second support surface and the third support surface have different protrusion heights with respect to the first support surface.

5. The damper spring structure of claim 3, wherein the contact surface portion is configured such that the second support surface and the third support surface have different elastic forces.

6. The damper spring structure of claim 3, wherein the inclined surface portion comprises:

a first inclined surface configured to inclinedly connect the first support surface and the second support surface, and a second inclined surface configured to inclinedly connect the second support surface and the third support surface.

7. The damper spring structure of claim 3, wherein the corresponding surface portion provided on the lid comprises:

the first support surface configured to be in contact with the second support surface of the damper spring, and the second support surface positioned radially inward from the first support surface, and disposed on the central portion, and configured to be in contact with the third support surface of the damper spring.

8. The damper spring structure of claim 7, wherein the second support surface of the lid has a higher protrusion height than the first support surface of the lid to accommodate a second inclined surface and the third support surface of the damper spring and allow an edge portion thereof to come into contact with the second inclined surface and the third support surface of the damper spring.

9. The damper spring structure of claim 3, wherein the corresponding surface portion provided on the housing comprises:

a seating surface configured to be in contact with the second support surface of the damper spring, and a base surface positioned radially inward from the seating surface and configured to accommodate the second inclined surface of the damper spring and the third support surface of the damper spring.

10. The damper spring structure of claim 9, wherein the housing has a center hole formed in a central portion of the seating surface to accommodate the second inclined surface and the third support surface of the damper spring.

11. The damper spring structure of claim 1, wherein the damper spring defines a vertical symmetric structure separated vertically and comprising an upper damper spring disposed to face the lid and a lower damper spring disposed to face the housing.

* * * * *